United States Patent [19]

Lin

[11] 4,050,469

[45] Sept. 27, 1977

[54] COMB WITH DISPOSABLE COMB-TEETH MODULE

[76] Inventor: Chung-Sing Lin, 182-2 Chung Shan Rd., Shan Hua Chen, Tainan Hsien, Taiwan, China /Taiwan

[21] Appl. No.: 721,051

[22] Filed: Sept. 7, 1976

[51] Int. Cl.[2] ..... A45D 24/00

[52] U.S. Cl. ..... 132/11 R

[58] Field of Search ..... 132/11 R, 152, 154

[56] References Cited

U.S. PATENT DOCUMENTS

| | | | |
|---|---|---|---|
| 1,173,053 | 2/1916 | Sommer | 132/154 |
| 1,482,242 | 1/1924 | Michaud | 132/152 |
| 2,551,131 | 5/1951 | Iesersek | 132/154 |
| 3,978,870 | 9/1976 | Lin | 132/11 R |

*Primary Examiner*—G.E. McNeill

[57] ABSTRACT

A novel comb is disclosed comprising a comb back, a comb-teeth module detachably mounted on the comb back, and a case member connected to one end of the comb back for serving as a handle. The comb-teeth module comprises at least one continuous wire wound helically into a plurality of coil-shaped comb tooth elements with each coil-shaped comb tooth element having an upper portion serving as supporting means to be fitted on the comb back and a narrowed and elongated lower portion for combing, wherein the narrowed and elongated lower portion of the comb-teeth module is capped with a removable cap member to normally assume a retracted condition having comb teeth compacted, and adapted to resume an extended condition having comb teeth spaced apart for use after the cap member being removed. The novel comb further comprises a plurality of spare comb-teeth modules arranged inside the case member, and a dispensing mechanism for delivering one of the spare modules to a position for use after the soiled module has been discarded.

5 Claims, 8 Drawing Figures

Fig.1
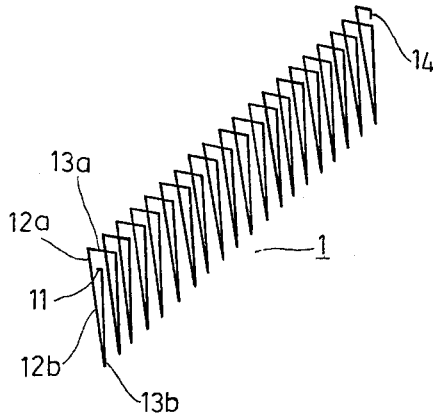
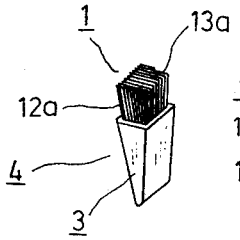
Fig.2a
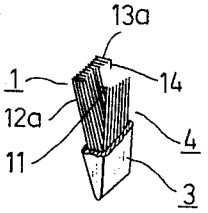
Fig.2b
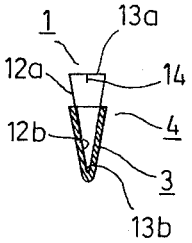
Fig.2c
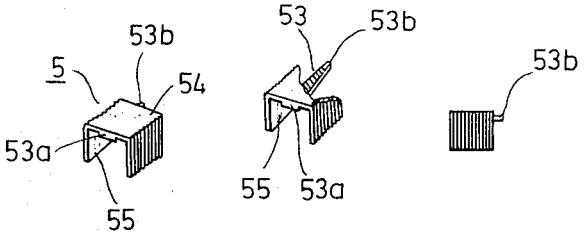
Fig.6

Fig. 4
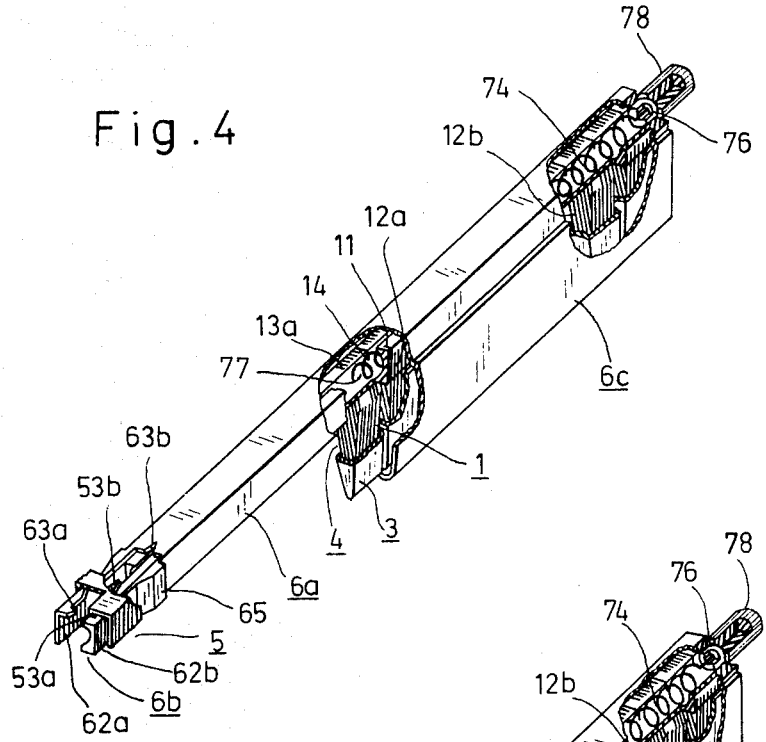
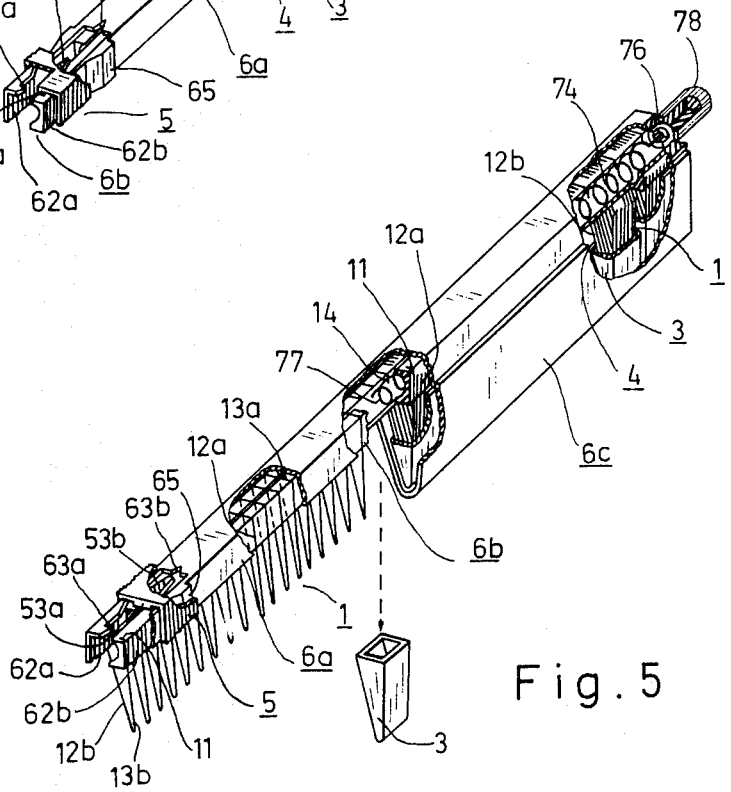
Fig. 5

COMB WITH DISPOSABLE COMB-TEETH MODULE

BACKGROUND OF THE INVENTION

This invention relates to a novel comb, and more particularly to a comb having a detachably mounted comb-teeth module which can be thrown away after use.

A comb heretofore used, whether it is conventional or improved, generally consists of three main portions, namely, a plurality of comb teeth, a comb back for supporting the comb teeth, and a handle connected to the comb back for handling. The comb teeth are generally formed integrally with or permanently secured to the comb back portion. Such a construction has certain disadvantages. For example, it is recognized that the comb teeth have a tendency to break during manufacturing, and a comb having one of its comb teeth broken would not be available to a buyer and should be discarded, thus to result in an increase of manufacture cost. Furthermore, the comb teeth of such a construction are easily soiled, and once they are solid, difficulty will arise in brushing off the contaminants, especially the mixture of dandruff, hair oil and dirt etc. existing in the gaps between the teeth. In addition, each tooth of the conventional construction generally has a rough surface with sharp edges and a sharp tip which cause considerable damage to the hair or the integument of the user's head during combing.

As is known in the art to which this invention relates, various modifications and improvements have been proposed, such as to provide a sheath for protectively housing the comb, or to provide a device which may be employed both as a comb case and as a cleaner therefor, and so forth. However, the cleaner device itself tends to be the source of further cleaning problem, since the contaminants from the comb teeth will attach onto the cleaning means and will return to the comb teeth if they are not completely removed from the cleaning means. Hence, so long as the aesthetic appearance and hygienic condition of the comb are taken into account, some of the aforementioned problems still exist.

SUMMARY OF THE INVENTION

It is therefore an object of this invention to thoroughly eliminate the various disadvantages of the previous comb and to provide a comb of novel type comprising a comb teeth module which is detachably mounted on a comb back and which may be replaced with new ones after being soiled.

It is another object of this invention to provide a novel comb-teeth module comprising at least one continuous wire wound helically into a plurality of coil-shaped comb tooth elements with each coil-shaped comb tooth element having an upper portion shaped to define a channel adapted to fit an elongated member therein and a narrowed and elongated lower portion for combing, wherein the narrowed and elongated lower portion of the comb-teeth module is capped with a removable cap member by means of which the comb-teeth module is adapted to normally assume a retracted condition having comb teeth compacted, and to resume an extended condition having comb teeth spaced apart for use after the cap member being removed.

It is a still further object of this invention to provide a novel comb comprising an elongated comb back, a case member connected to one end of the comb back for serving as a handle, a plurality of comb-teeth modules supported in alignment with each other by the comb back inside the case member, and a dispensing mechanism arranged for causing one of the comb teeth modules to emerge from the inside of the case member to a position whereby the comb-teeth module can be removed the cap member to resume its extended condition for use, after the soiled module has been removed.

Accordingly, the important features of the novel comb according to this invention reside in that the comb may always be kept in hygienic condition by replacing the soiled comb teeth module with spare ones delivered by the dispensing mechanism thereof, that the comb-teeth module is formed with a single continuous wire having round and smooth surfaces, that the tip of each tooth is not so sharp as the conventional one, and that the dispensing mechanism is designed such that, by manual operation, the comb-teeth module may be delivered in resonable and convenient manner.

With these and other objects, features, and advantages in view, this invention comprises a novel construction, arrangement and formation of parts, as will be hereinafter more specifically described, by way of example, with reference to the accompanying drawings.

BRIEF DESCRIPTION OF THE DRAWING

FIG. 1 is a perspective view of a comb-teeth module according to this invention in an extended condition having particularly shaped coils spaced apart to serve as comb teeth.

FIG. 2*a* to 2*c* are perspective views and side view of a comb-teeth module of FIG. 1 being capped with a cap member to normally assume a retracted condition having the particularly shaped coils closely compacted.

FIG. 4 shows the novel comb of FIG. 3, partly cut away, illustrating a plurality of comb-teeth modules are contained in a dispensing mechanism and one of the comb-teeth is at the position adjacent to the handle.

FIG. 5 shows the novel comb of FIG. 3, partly cut away, illustrating that one of the comb-teeth modules resumes its extended condition having comb teeth spaced along the comb back and fixed for use, after the cap member is removed.

FIG. 6 is a fragmentary, perspective view and side view of the clamping member of the locking means for removably locking the comb-teeth module with respect to the comb back.

DETAILED DESCRIPTION OF THE PREFERRED EMBODIMENT

Figure 3:
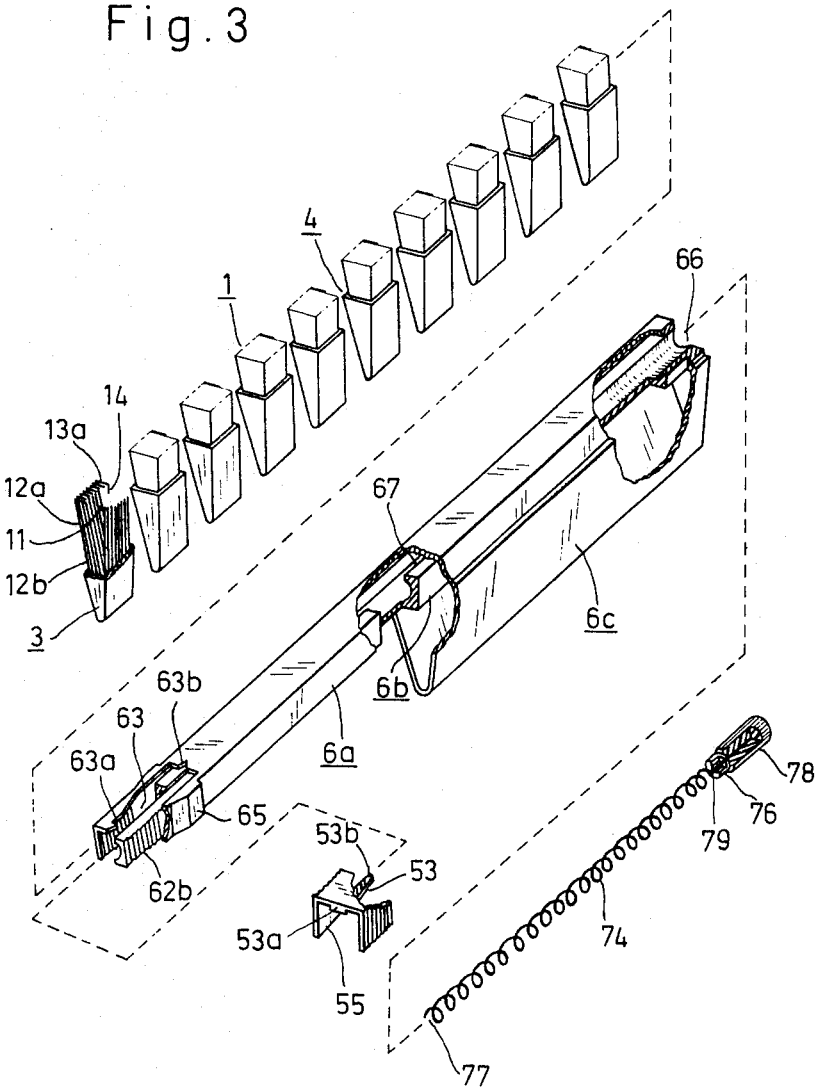
FIG. 3 is an exploded perspective view of a novel comb according to this invention.

Reference is now made to the drawings for a better understanding of this invention, wherein similar reference characters designate corresponding parts throughout the several views. As is evident in FIG. 1, a novel comb-teeth module in extended condition, generally designate by numeral 1, comprises a single continuous wire wound helically into a series of coils aligned in juxtaposition with each coil including a narrowed and elongated lower portion 12*b* presenting a tip 13*b* and an upper portion having two opposite side sections 12*a* of straight shape and a top side 13*a* of straight or arcuate shape, the upper portion serves as supporting means for fitting on an elongated member. A segment of suitable length at the trailing end 14 of the wire is deflected at the middle of the top side 13*a* into the plane defined by the coil in order to function as a contact, of which the purpose will be more apparent hereinafter.

Normally, the comb-teeth module of FIG. 1 is resiliently held in a retracted condition having coils compacted with a cap member 3 as shown in FIGS. 2*a* to 2*c*. The cap member 3 is preferably made from a material including polyvinyl chloride resin and has a size adapted to snugly fit the narrowed and elongated lower portion of the retracted module against the resilient force resulted from the spring-like coils. With this arrangement, the capped comb-like module, generally designated by numeral 4, is able to restore its extended condition when the cap member 3 is removed. It should be noted, a hard-drawn steel wire having a diameter ranging from 0.30 mm to 0.35 mm and a tensile strength greater than 260 kg/mm$^2$ or a piano wire having a diameter ranging from 0.29 mm to 0.35 mm and a tensile strength greater than 270 kg/mm$^2$ is preferably selected for a comb-teeth module described heretofore, and typically, with the top side 13*a* having a length of 5.5 mm, the opposite sides 12*a* having a length of 5 mm, and the lower portion having a length equal to 14 mm, a good combing effect may be obtained as the comb-teeth module has twenty coils spaced apart from each other with a uniform distance of 3 mm. In addition, the hard-drawn steel wire or piano wire thus selected has been subjected to a patenting treatment for increasing toughness and subjected to a blueing treatment for increasing resilient force, so that the comb-teeth module is able to resume its original extended shape after the cap member 3 is removed, and the wire is coated with a layer of oxide film for rust prevention due to the above-mentioned blueing treatment.

Turning now to FIG. 3, a preferred embodiment of the novel comb according to this invention is shown in an exploded view. As can be seen, the novel comb comprises a plurality of capped comb-teeth module 4 including comb-teeth module 1 and cap member 3, a comb back portion including a hollow supporting shaft 6*b* housed with a shaft housing 6*a*, a case member 6*c* connected to the shaft housing 6*a*, and a dispensing mechanism including a screw body 74 rotatably mounted in the hollow of the supporting shaft 6*b* inside the chamber defined by the shaft housing 6*a* and case member 6*c*.

The supporting shaft 6*b* and the shaft housing 6*a* are arranged in a manner that there is a gap defined between the inner surface of the housing 6*a* and the outer surface of the shaft 6*b*, and extending along the longitudinal direction of the shaft, and the shaft housing 6*a* has its side facing downward opened, such that the upper portion of the capped comb-teeth module 4, which portion serves as supporting means as mentioned above, can be slidably fitted on the shaft 6*b* with the upper portion of the capped comb-teeth module confined in the gap between the inner surface of the shaft housing 6*a* and the outer surface of the shaft 6*b*, while having the lower portion of the capped comb-teeth module protruded downwardly out of the shaft housing, as shown in FIG. 4. Furthermore, the gap is communicated into the chamber of the case member 6*c*, so that the comb-teeth module with its upper portion fitted on the supporting shaft is adapted to move into or out the case member along said gap.

The screw body 74 has a free end 77, while the other end thereof is a straight segment 79 extending in the axial direction. The screw body 74 is disposed in the hollow of the shaft 6*b* inside the case member 6*c* with its straight segment 79 rotatably journaled at the outer end 66 of the hollow by means of a collar 76, and, outside the hollow of the shaft 6*b*, a knob 78 is connected to the outermost end of the straight segment 79 of the screw body 74, so that the screw body 74 can be rotated in either direction through rotation of the knob 78.

As can be seen from FIG. 3, the upper face of the supporting shaft 6*b* is provided with a slit 67, which extends along the entire length of the shaft 6*b* and has a depth extending downward to the hollow of the shaft 6*b*, so that the trailing portion 14 of the wire of the capped comb-teeth module 4 fitted on the supporting shaft 6*b* inside the case member 6*c* is extended into the hollow of the shaft through the slit 67 and becomes in contact with the screw body 74, as shown in FIG. 4. With such design, all of the trailing portions of the comb-teeth modules inside the case member are moved at the same time as the rotation of the screw body 74 occurs, and, as the trailing portion 14 of the comb-teeth module is guided along the slit 67 by the rotation of the screw body 74, the capped comb-teeth modules fitted on the shaft inside the case member is able to be moved to the free end 77 of the screw body, where the capped comb-teeth module can be removed its cap member 3 and resume its original extended condition for use.

When the capped comb-teeth module 4 outside the case member as shown in FIG. 4 is removed its cap member 3, the comb-teeth module thus resumes its original shape and has its trailing portion 14 in engagement with the free end 77 of the screw body while its leading portion near the end of the shaft remote from the case member 6*c*. In order to fix the leading portion of the extended comb-teeth module with respect to the supporting shaft, a clamping member 5 is provided. The clamping member 5, as best shown in FIG. 6, includes an upper side 54 and two opposite sides 55 connected to the opposite ends of the upper side 54. On the inner surface of the upper side, there is provided a key 53 having a shape tappering from one end 53*a* of maximum width to the other end 53*b* of minimum width. On the other hand, the upper side of the shaft housing 6*a* at the outer end remote from the case member is provided with an elongated opening 63, as best shown in FIG. 3, and the opposite sides of the shaft housing by the opening 63 are provided with a trapezoidal seat 65 which is outwardly projected from the surface of the housing. The outer end 63*a* of the opening 63 is tapered to serve as a seat for the outer end 53*a* of the key 53 on the clamping member 5, and the edge of the inner end of the opening 63 has a notch 63*b* which serves as a seat for the inner end 53*b* of the key 53. The clamping member 5 is adapted to be fitted on the shaft housing 6*a* with its opposite side 55 tightly clamping on the trapezoidal seat 65 and with the inner end 53*b* of the key 53 inserted in the notch 63*b* of the housing 6*a*, so as to force the opposite sides of the shaft housing 6*a* to clamp the upper portion of the extended comb-teeth module existing in the gap fixedly against the outer surface of the shaft 6*b*, and preferably, the outer surface 62*b* of the opposite sides of the shaft end is shaped into parallel grooves and ridges in order to confine the wire of the comb-teeth module in the grooves. The clamping member 5 upon the trapezoidal seat 65 may be slid to the outer end of the shaft to a position where the outer end 53*a* of the key 53 is inserted into the tapered outer end 63*a* of the elongated opening 63 in the upper side of the shaft housing 6*a*, whereby releasing the clamping force and maintaining the original size of the gap between the shaft and the housing for allowing passage of the upper portion of the comb-teeth module which is to be discarded or recapped with a cap member.

The operation of the novel comb is believed to be clearly apparent and is briefly summarized at this point.

To employ the novel comb, by rotating the knob 78, one of the capped comb-teeth modules inside the case member 6c is moved out to a position having its trailing portion 14 hooked by the free end 77 of the screw body 74, as shown in FIG. 4. With the clamping member 5 slid off the trapezoidal seat 65 of the shaft housing 6a, this comb-teeth module resumes its original shape having coil-shaped comb teeth spaced along the comb back for use after the cap member 3 thereon is removed, and then the clamping member 5 is slid back onto the trapezoidal seat 65 to fix the comb-teeth module, as shown in FIG. 5, while the other end of the comb-teeth module is fixed by the engagement of the trailing portion 14 with the free end 77 of the screw body.

When not in use, the clamping member 5 is released and the comb teeth are compacted into the retracted position and re-capped with the cap member 3, as shown in FIG. 4, and if desired, the re-capped comb teeth module may be moved back into the case member by rotation of the knob 78 in reverse direction. In such retracted and compacted position and being capped with the cap member 3, the teeth are prevented from damage and soiling. Once the comb teeth are soiled or worn out such as to be thrown away, by turning the knob 78, the soiled comb-teeth module is moved and separated from the free end 77 of the screw body 74 to be removed and a new module is automatically delivered from the inside of the case member 6c to the position having its trailing portion 14 caught by the free end 77 of the screw body for future use.

Although this invention has been herein shown and described in what is conceived to be the most practical and preferred embodiment, it is recognized that departures may be made therefrom within the scope of this invention which is not to be limited to the details disclosed herein but is to be accorded with the full scope of the claims so as to embrace any and all equivalent devices and apparatuses.

What is claimed is:

1. A comb comprising:

a comb back portion;

a case member connected to one end of the comb back portion for serving as a handle; and, a plurality of comb-teeth modules arranged inside the case member; wherein each one of the comb-teeth modules includes a continuous wire wound helically into a plurality of normally-spaced apart coil-shaped comb tooth elements and a cap member removably capping the comb tooth elements in a compacted condition, thereby preventing the comb teeth from collecting dirt which may enter during opening of the case member and from an unintentional breakage of the case member and isolating the compacted comb-teeth modules from each other to prevent them from passing over or entangling with each other, each of the comb-teeth modules being adapted to be moved, by means of a dispensing mechanism in the case member, onto the portion of the comb back outside the case member to resume an extended condition having comb teeth spaced apart for use after the cap member is removed.

2. A comb comprising:

a comb back portion;

a case member connected to one end of the comb back portion for serving as a handle; and, a plurality of comb-teeth modules arranged inside the case member, each of the plurality of comb-teeth modules including a continuous wire wound helically into a plurality of normally-spaced apart coil-shaped comb tooth elements and a cap member removably capping the comb tooth elements in a compacted condition, each coil-shaped comb tooth element having an upper portion serving as support means and a narrowed and elongated lower portion for combing, and an angled trailing end portion of the wire serving as retaining means; and wherein the comb back portion includes a supporting shaft and a shaft housing covering the supporting shaft, the gap defined between the inner surface of the shaft housing and the outer surface of the supporting shaft forming a passage for the comb-teeth modules, while the interior space of the case member is communicated with said passage, and the supporting shaft is made hollow and has a screw body rotatably disposed therein, the upper portion of each comb-teeth module being fitted onto the supporting shaft, the surface of the supporting shaft being provided with a slit extending longitudinally of the shaft and having a depth communicating into the hollow of the supporting shaft, while the trailing end portion of the wire of the comb-teeth module is directed into the hollow of the shaft via the slit to engage with the screw body, so that the comb-teeth module is adapted to be moved along the shaft with the trailing end portion of the wire being guided along the slit upon the rotation of the screw body.

3. A comb as defined in claim 2, wherein the end of the comb back portion remote from the case member is provided with locking means for locking the upper portions of the comb teeth which are those adjacent to the remote end of the shaft as the comb-teeth modules resumes its extended condition after the cap member thereof being removed, while the trailing end portion of the wire is fixed by the engagement of the trailing end portion with the screw body.

4. A comb-teeth module comprising at least one continuous wire wound helically into a plurality of coil-shaped comb tooth elements with each coil-shaped comb tooth element having an upper portion serving as support means and a narrowed and elongated lower portion for combing, characterized in that the narrowed and elongated lower portion of the comb-teeth module is capped with a removable cap member to normally assume a retracted condition having comb teeth compacted, and adapted to resume an extended condition having comb teeth spaced apart for use after the cap member being removed.

5. A comb-teeth module as defined in claim 4, wherein the upper portion of the coil-shaped comb tooth element includes two opposite sides of straight shape and one top side of straight or arcuate shape.

* * * * *